US006450855B1

(12) United States Patent
Tang

(10) Patent No.: US 6,450,855 B1
(45) Date of Patent: Sep. 17, 2002

(54) STRUCTURAL IMPROVEMENT OF ANGEL DOLL'S TRANSMISSION

(76) Inventor: Tai-Ning Tang, 581 Kamoku St. #3506, Honolulu, HI (US) 96826

( * ) Notice: Subject to any disclaimer, the term of this patent is extended or adjusted under 35 U.S.C. 154(b) by 0 days.

(21) Appl. No.: 09/761,731

(22) Filed: Jan. 18, 2001

(51) Int. Cl.[7] ..... A63H 3/20; G09F 19/08

(52) U.S. Cl. ..... 446/330; 446/354; 446/485; 40/411

(58) Field of Search ..... 446/219, 330, 446/352, 353, 354, 358, 485; 90/410, 411, 412, 413, 414, 415

(56) References Cited

U.S. PATENT DOCUMENTS 5,121,646 A * 6/1992 Cho ..... 40/411
5,247,753 A * 9/1993 Yang ..... 40/414
6,082,876 A * 7/2000 Hanson et al. ..... 446/485
6,171,170 B1 * 1/2001 Lin ..... 446/397
6,180,193 B1 * 1/2001 Bostedt ..... 362/806
6,264,520 B1 * 7/2001 Yamazaki et al. ..... 445/4
6,322,421 B1 * 11/2001 Hou ..... 446/219

* cited by examiner

*Primary Examiner*—Jacob K. Ackun
*Assistant Examiner*—Faye Francis
(74) *Attorney, Agent, or Firm*—Rabin & Berdo, P.C.

(57) ABSTRACT

An angel doll for displaying on a table or mounted on a Christmas tree in Christmas season or such occasion includes a slow transmission device inside a base. The transmission includes a main shaft that drives a palette, two rotating cylinders and two rotating rods, so the palette rotates slowly, and colorful rays can be projected from the lamp inside the base, through the two rotating cylinders, to the margins of the optical fiber wing units. The swinging movement activated by the two rotating cylinders and the two rotating rods through the connecting rods and the side shaft in linkage, causes the wing units and the arm units to swing reciprocally, creating an active and lively atmosphere to the angel doll.

5 Claims, 5 Drawing Sheets

STRUCTURAL IMPROVEMENT OF ANGEL DOLL'S TRANSMISSION

BACKGROUND OF THE INVENTION

This invention is a structural improvement of an angel doll's transmission, particularly a structural improvement involving an eccentric side shaft and a main shaft that rotate slowly, simultaneously driving two rotating cylinders (two wing units linked to the doll) and two rotating rods (two arm units linked to the doll) to swing slowly to and fro, enabling connection with the cylinder to mount the whole unit on a Christmas tree, creating more active and lively movement to the angel doll, and providing the convenience of display.

Due to fast development of information technological, exchange of religions, cultures and technology between nations has become more frequent, resulting in a high degree of common features. Festivals and holidays, such as Christmas, Valentine's Day, etc. have become common occasions in global proportions. Especially on Christmas, most families would put up some decorations, particularly Christmas trees. Decorative items on the Christmas trees come in all shapes and sizes, including color ribbons, color balls, small gadgets, small dolls, etc. Angel dolls, in particular, are an essential symbol representing peace and grace. Conventional angel dolls are either static or dynamic. The static ones, which are irrelevant to the subject invention, will not be included in the following description. FIG. 1 shows a conventional type of dynamic angel doll, using a base unit adorned with appropriate apparel, as well as body parts such as head, arms, wings, etc. But generally only the arms are moving. A drive unit installed inside the base will drive two arm rods to open and close repeatedly. Such repeated movement has obviously become monotonous and no longer looks amusing. Another shortcoming of the conventional angel doll is that its base is normally placed on a table or a counter, instead of on a Christmas tree. Therefore, its display effects are quite limited.

BRIEF DESCRIPTION OF THE INVENTION

In view of the above shortcoming of conventional angel dolls, the subject inventor has devoted in research and improvement and after repeated conception, tests, revisions and modifications, based on many years of experience accumulated in the design and production of toys and giftware, has finally come up with the "structural improvement of an angel doll's transmission", enabling such features as colorful rays, simultaneous and graceful swinging movement of arms and wings, lively and moving figure, capable of being displayed on a plane or easily mounted on top of a Christmas tree, upgraded applicability and convenience.

BRIEF DESCRIPTION OF DRAWINGS

The drawings of preferred embodiments of this invention are described in following details to enable better understanding.

DETAILED DESCRIPTION OF PREFERRED EMBODIMENTS

Figure 1:
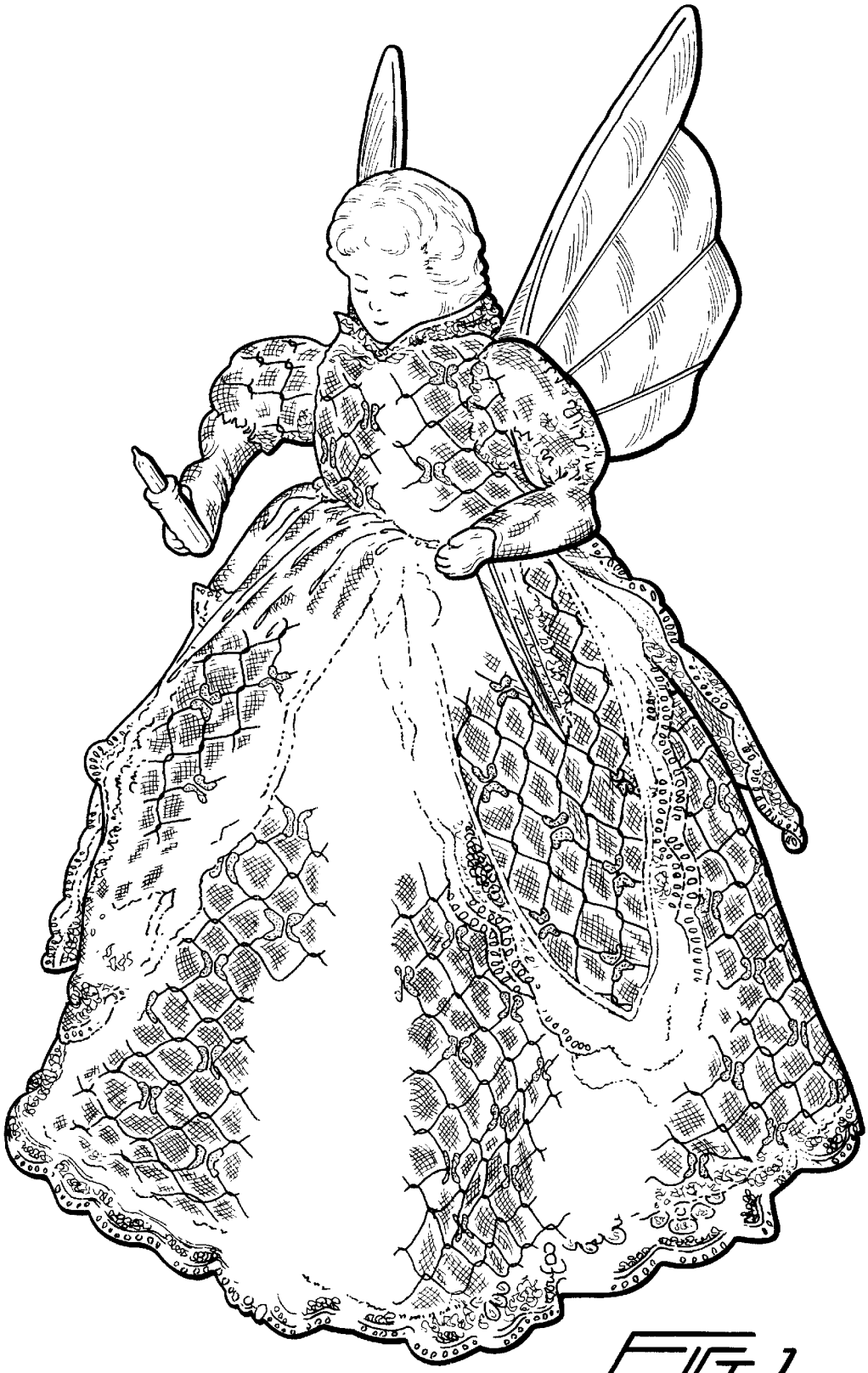
FIG. 1 (PRIOR ART)
FIG. 1 is a view of a conventional doll of dynamic angel.
Figure 2:
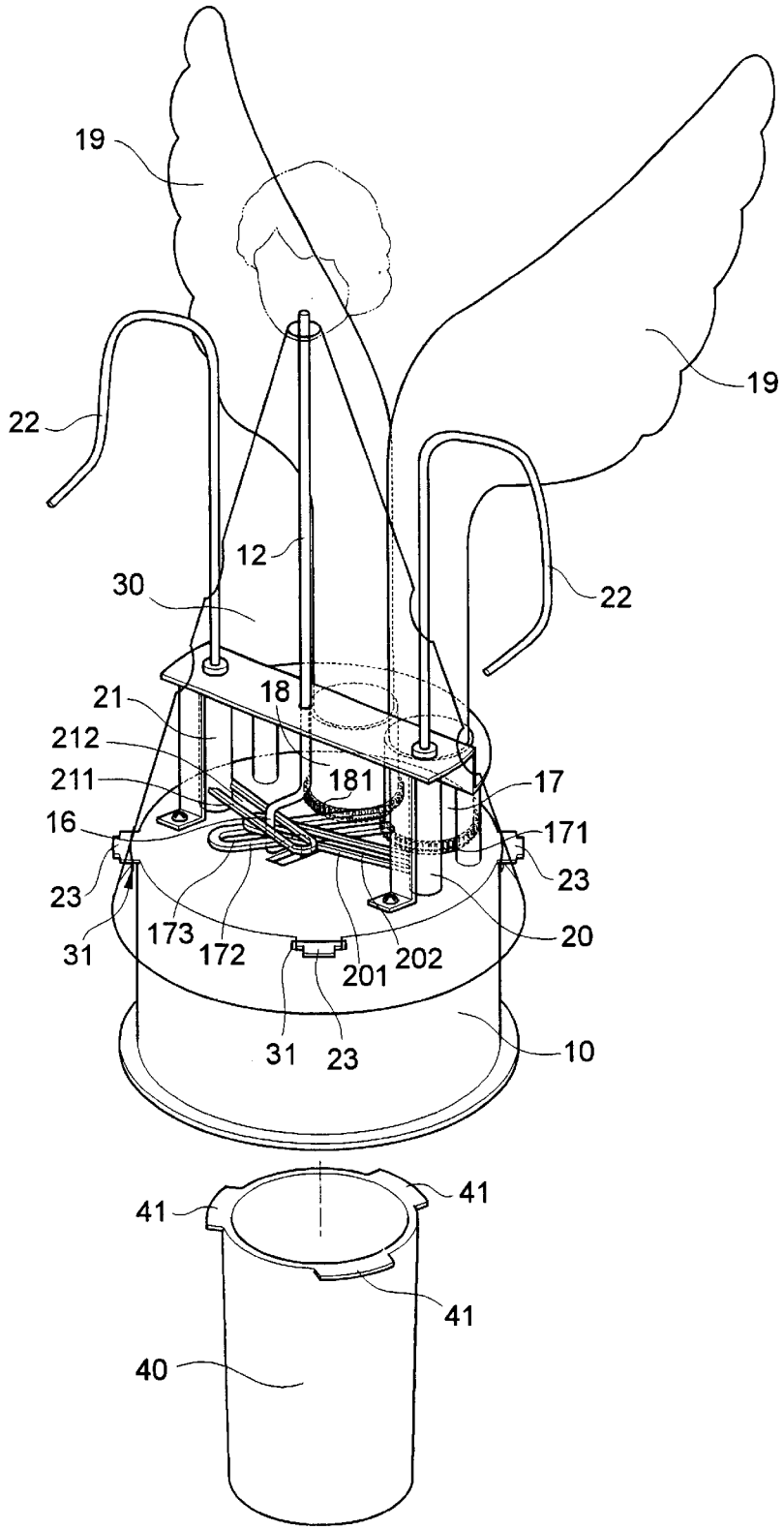
FIG. 2 is a perspective view of this invention.
Figure 3:
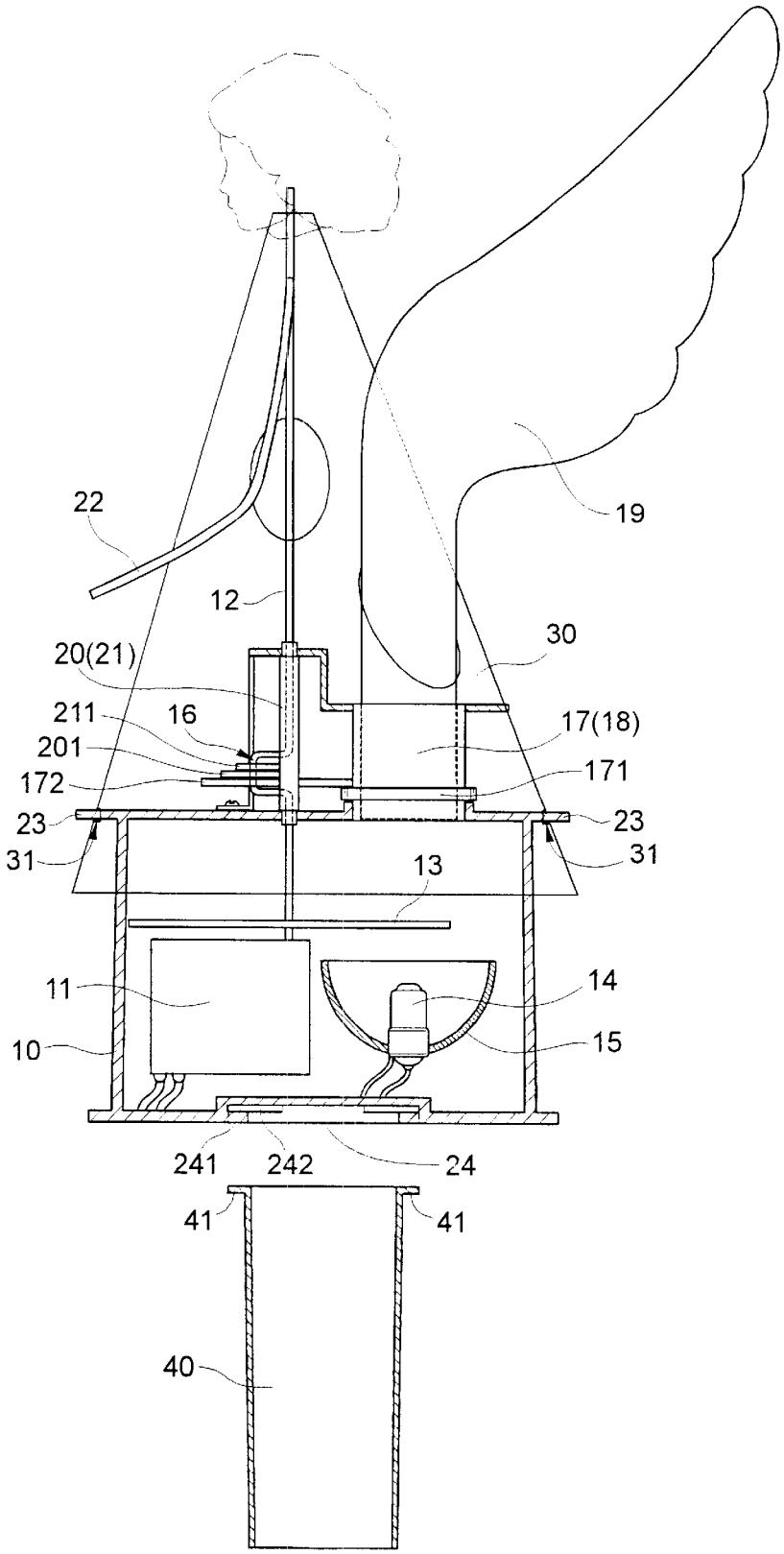
FIG. 3 is a section view of this invention.
Figure 4:
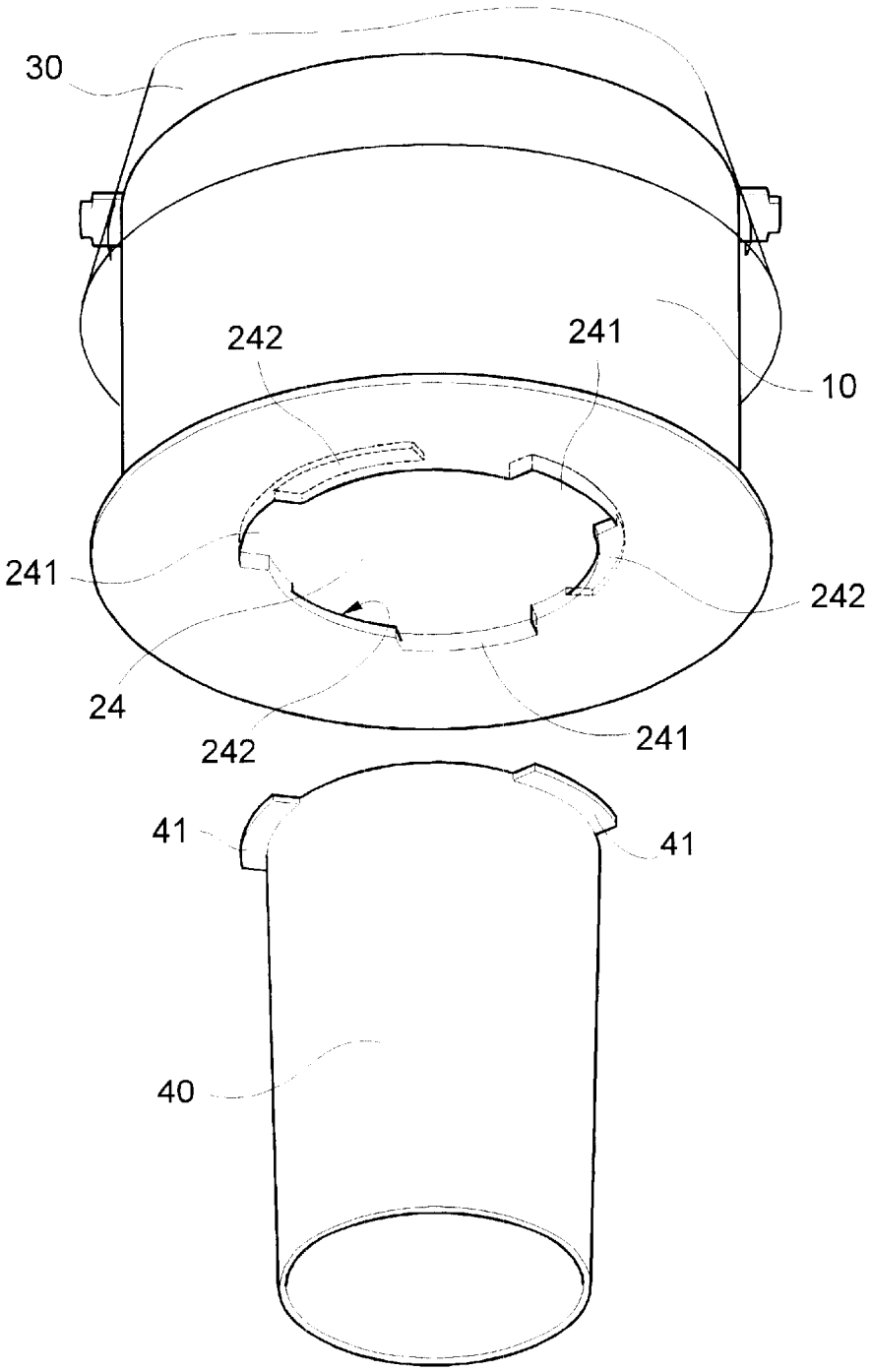
FIG. 4 is a perspective view of the assembly of the base and the cylinder in this invention.

As shown in FIGS. 2 through 4, this invention comprises a foundation unit, a cover unit 30 and a cylinder 40, wherein:

The foundation unit is a hollow base 10. Inside the base 10 is installed a slow transmission device 11 that is composed of a motor and a reduction gear. Extended from the slow transmission device 11 is a main shaft 12, which slowly rotates, extending vertically to the top of the base 10. At a section of the main shaft 12 inside the base 10 is mounted a palette 13. The palette 13 is made of transparent material. The palette is divided into several areas of different colors or patterns. Beside the slow transmission device 11 is a lamp 14. Light coming directly from the lamp 14 and reflected from a lamp hood 15 beside it can project the colors or patterns through the color areas on the palette 13 toward the top. An intermediate portion of the main shaft 12 has an eccentric side shaft 16 extending sideways. The side shaft 16 will rotate eccentrically with the slow rotation of the main shaft 12. At the back of the top of the base 10 are two through holes to accommodate two pieces of hollow rotating cylinders 17, 18. At the bottom of the two rotating cylinders 17, 18 are gears 171, 181 that are meshed for transmission purpose. Protruding horizontally from the side of one of the rotating cylinders 17 is a connecting rod 172. Inside the connecting rod 172 is a chute 173. The chute 173 is connected with the eccentric side shaft 16 of the main shaft 12 and driven by the side shaft 16. Respectively inside the two rotating cylinders 17, 18 are inserted fiberglass-woven wing units 19. The light projected through the palette 13 from the lamp 14 inside the base 10 shines on the bottom of the wing units 19 inside the two rotating cylinders 17, 18, making colorful rays visible on the margins of the wing units 19 (the terminals of optical glass fibers). Hinged respectively at two sides of the top the base 10 are two rotating rods 20, 21. Protruding horizontally from the sides of the two rotating rods 20, 21 are connecting rods 201, 211. Respectively inside the connecting rods 201, 211 are two chutes 202, 212. By linking the two chutes 202, 212 to the side shaft 16, the two rotating rods 20, 21 can be driven by the side shaft 16. The tops of the two rotating rods 20, 21 are linked to two arm units 22. Protruded from the top rim of the base 10 are several protruded ears 23. At the bottom of the base 10 is a depressed insert groove 24. As shown in FIG. 4, the on the rim of the insert groove 24 are several recesses 241. On the sides of the recesses 241 are sideway extended inside holes 242.

The cover unit 30 is a hollow cone shape. On the rim of its bottom and matching the protruded ears 23 of the base 10 are several groove holes 31. The groove holes 31 and the protruded ears 23 are coupled to fasten the cover unit 30 onto the top of the base, to the extent that the top of the main shaft 12 is extended out of the top opening of the cover unit 30 (serving to position the main shaft 12). On the surface of the cover unit 30 and matching the locations of the wing units 19 and the arm unit 22 are respectively openings to enable their extension.

The cylinder 40 is a hollow unit. On its top rim and opposite the recesses 241 of the insert groove 24 of the base 10 are several protruding plates 41. The protruding plates 41 are inserted into respective recesses 241 of the insert groove 24 before the cylinder 40 is rotated, so that the protruding plates 41 are inserted into the inside holes 242, and the cylinder is fastened to the bottom of the base 10.

Figure 5:
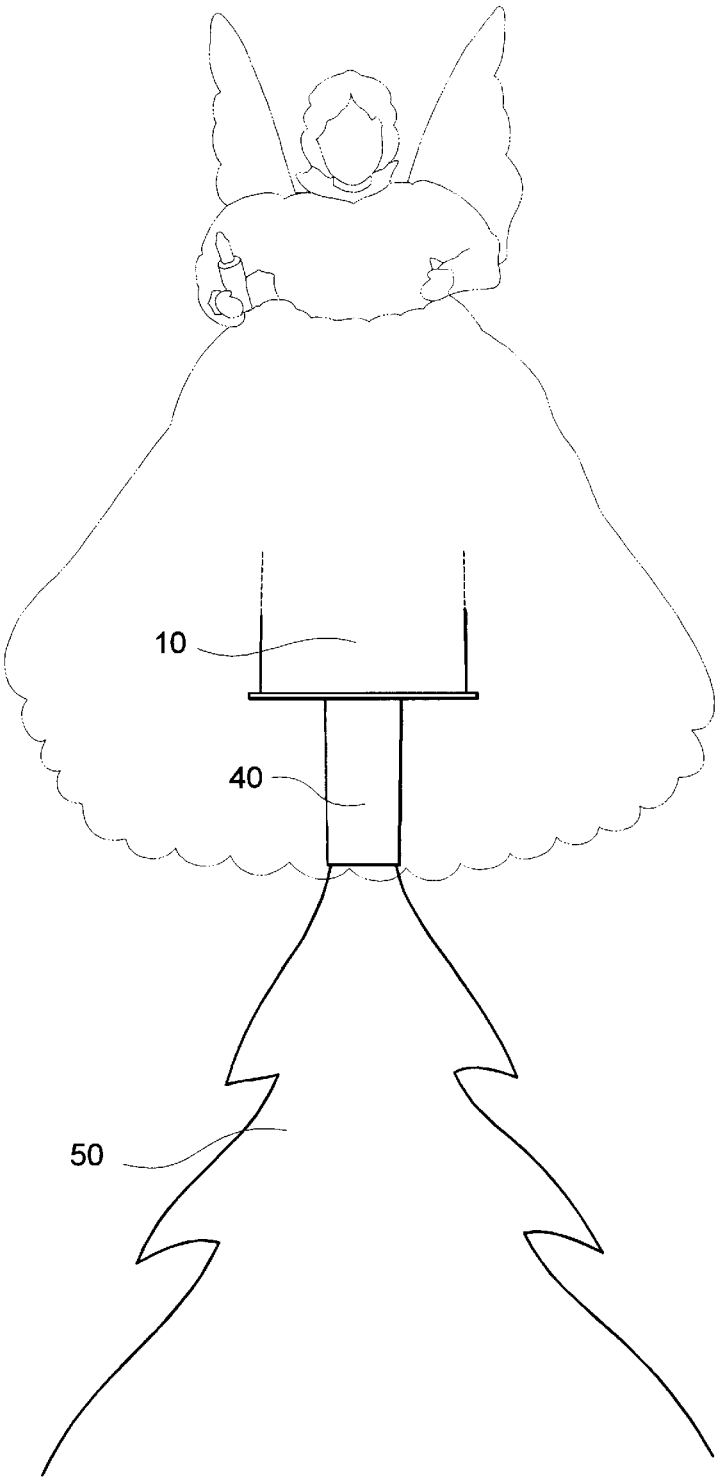
FIG. 5 illustrates how this invention is fixed with the cylinder to the top of a Christmas tree.

With the abovementioned construction, when the power of the slow transmission device 11 is switched on to slowly rotate the main shaft 12, the palette 13 on the main shaft 12 will rotate slowly, and the lamp 14 will project colorful rays, through the different color and pattern areas on the palette 13 and through the rotating cylinder 17, 18, onto the margins of the wing units 19. Meanwhile, the eccentric side shaft 16 extending from the main shaft 12 will also rotate eccentrically and slowly. Then, the simultaneous movement of the side shaft 16, the connecting rod 172 of the rotating cylinder 17, and the connecting rods 201, 211 of the rotating rods 20, 21 will drive the rotating cylinder 17 and the two rotating rods 20, 21 to swing to and fro. Since the gear 171 and the gear 181 of the other rotating cylinder 18 are meshed, the rotating cylinder 17 will drive the rotating cylinder 18 to move reciprocally in a reverse direction. Therefore, the wing units 19 and the arm units 22 that are linked to the rotating rods 20, 21 and the rotating cylinders 17, 18 will create graceful, reciprocal swinging movement, which is much more active and lively than the conventional construction. This invention can be displayed by putting the base 10 on a table or inside a counter. Or, as shown in FIG. 5, this invention can also be mounted on top of a Christmas tree by fastening the cylinder 40 to the bottom of the base 10, before mounting the hollow part of the cylinder 40 on the top of a Christmas tree, which is a feature for selective position for display.

To conclude, the exquisite structural design of this invention enables the arms and wings of the angel doll to move to and fro softly and elegantly, and enables the convenience of displaying it on a flat object or mounting it on top of a Christmas tree, thus effectively enhancing fun, amusement, liveliness and applicable convenience to the doll. Compared with conventional models, this invention has proved its inventiveness, innovativeness and enhanced performance. Therefore, this application is filed for a patent right. Your favorable consideration will be appreciated.

What is claimed is:

1. An angel doll, comprising:

a foundation unit, said foundation unit having a hollow base, said hollow base having a top and a bottom, the top having two holes at a rear portion thereof, a top rim of said base having a plurality of protruding ears extending therefrom, the bottom of said base having an insert groove, a rim of the insert groove having a plurality of recesses, a sideways-extending inside hole being formed adjacent to each recess;

a slow transmission device disposed inside said base;

a main shaft that extends vertically from said slow transmission device to and past the top of said base, said slow transmission device causing said main shaft to slowly rotate, said main shaft having an intermediate section disposed above the top of said base, the intermediate section having an eccentric side shaft that extends sideways, said side shaft being eccentrically rotatable with a rotation of said main shaft;

two hollow rotating cylinders, each being disposed in a respective one of the holes in the top of said base, and each having a gear at a bottom rim thereof, said gears being intermeshed, one of said rotating cylinders having a connecting rod attached to a side thereof, an inside of said connecting rod being a chute, the chute and said side shaft being linked so that when said side shaft eccentrically rotates, said connecting rod is driven to rotate said rotating cylinders, said rotating cylinders being adapted to receive wings that rotate with said rotating cylinders;

two rotating rods, each being disposed on a respective side of the top of said base, each rotating rod having a further connecting rod extending from a side thereof, each of said further connecting rods having a chute therein, said side shaft being linked to the chutes of said further connecting rods so that when said side shaft eccentrically rotates, said further connecting rods are driven to rotate said rotating rods;

two arm units, each being linked to a top of a respective rotating rod, said arm units rotating with said rotating rods;

a cover having a hollow cone shape, a bottom rim of said cover having a plurality of groove holes, each being disposed in registration with a respective protruding ear of said base, the protruding ears being insertable into the groove holes to fasten said cover to the top of said base, said cover having through openings to allow the wings and said arm units to extend therethrough; and a hollow cylinder having an opening at a bottom thereof, and having a top rim, the top rim having a plurality of protruding plates disposed in registration with the recesses in the insert groove of said base, said protruding plates being insertable into the recesses in the insert groove, so that when said cylinder is rotated, said protruding plates are moved to the inside holes, to fasten said cylinder to the bottom of said base.

2. The angel doll recited in claim 1, wherein said slow transmission device includes a motor and a reduction gear set.

3. The angel doll recited in claim 1, wherein a top of said main shaft extends out of a top opening of said cover.

4. The angel doll recited in claim 1, further comprising a transparent palette disposed in said base, and being driven to rotate with said main shaft; and a lamp that projects light through said transparent palette.

5. The angel doll recited in claim 4, wherein the light that is projected through said transparent palette is transmittable into the wings.

* * * * *